US008613810B2

(12) United States Patent
Mourer et al.

(10) Patent No.: US 8,613,810 B2
(45) Date of Patent: Dec. 24, 2013

(54) NICKEL-BASE ALLOY, PROCESSING THEREFOR, AND COMPONENTS FORMED THEREOF

(75) Inventors: David Paul Mourer, Beverly, MA (US); Kenneth Rees Bain, Loveland, OH (US)

(73) Assignee: General Electric Company, Schenectady, NY (US)

( * ) Notice: Subject to any disclaimer, the term of this patent is extended or adjusted under 35 U.S.C. 154(b) by 297 days.

(21) Appl. No.: 13/099,641

(22) Filed: May 3, 2011

(65) Prior Publication Data

US 2011/0203707 A1 Aug. 25, 2011

Related U.S. Application Data

(63) Continuation-in-part of application No. 12/474,580, filed on May 29, 2009.

(60) Provisional application No. 61/363,006, filed on Jul. 9, 2010.

(51) Int. Cl.
*C22C 19/05* (2006.01)
*C22F 1/10* (2006.01)

(52) U.S. Cl.
USPC ..... 148/410; 148/677; 148/428

(58) Field of Classification Search
USPC ..... 148/428, 410, 677; 420/448
See application file for complete search history.

(56) References Cited

U.S. PATENT DOCUMENTS 4,814,023 A * 3/1989 Chang ..... 148/513
4,957,567 A 9/1990 Krueger et al.
5,470,371 A * 11/1995 Darolia ..... 75/229
6,521,175 B1 2/2003 Mourer et al.
7,740,724 B2 6/2010 Clemens
2010/0329883 A1 12/2010 Mourer

FOREIGN PATENT DOCUMENTS

EP 1 666 618 A1 * 6/2006 ..... C22C 19/05
EP 2256222 A1 12/2010

OTHER PUBLICATIONS

PCT Search Report and Written Opinion dated Jun. 4, 2012 from corresponding Application No. PCT/US2011/043313.

* cited by examiner

*Primary Examiner* — Jessee Roe
(74) *Attorney, Agent, or Firm* — William Scott Andes; Gary M. Hartman; Domenica N. S. Hartman

(57) ABSTRACT

A gamma prime nickel-base superalloy and components formed therefrom that exhibit improved high-temperature dwell capabilities, including creep and dwell fatigue crack growth behavior. The superalloy contains, by weight, 10.00 to 22.0% cobalt, 10.0 to 14.0% chromium, 4.0 to 6.0% tantalum, 2.0 to 4.0% aluminum, 2.0 to 6.0% titanium, 1.5 to 5.0% tungsten, 1.5 to 5.0% molybdenum, 1.0 to 3.5% niobium, 0.05 to 0.6% hafnium, 0.02 to 0.10% carbon, 0.01 to 0.40% boron, 0.02 to 0.10% zirconium, the balance essentially nickel and impurities, wherein the titanium:aluminum weight ratio is 0.7 to 1.5. The superalloy is hot worked and heat treated to contain cellular gamma prime precipitates that distort grain boundaries, creating tortuous grain boundary fracture paths that are believed to promote the fatigue crack growth resistance of the superalloy.

10 Claims, 3 Drawing Sheets

NICKEL-BASE ALLOY, PROCESSING THEREFOR, AND COMPONENTS FORMED THEREOF

CROSS REFERENCE TO RELATED APPLICATIONS

This is a continuation-in-part patent application of U.S. patent application Ser. No. 12/474,580, filed May 29, 2009. The contents of this prior application are incorporated herein by reference.

BACKGROUND OF THE INVENTION

The present invention generally relates to nickel-base alloy compositions, and more particularly to nickel-base superalloys suitable for components, for example, turbine disks of gas turbine engines, that require a polycrystalline microstructure and a combination of disparate properties such as creep resistance, tensile strength, and high temperature dwell capability.

The turbine section of a gas turbine engine is located downstream of a combustor section and contains a rotor shaft and one or more turbine stages, each having a turbine disk (rotor) mounted or otherwise carried by the shaft and turbine blades mounted to and radially extending from the periphery of the disk. Components within the combustor and turbine sections are often formed of superalloy materials in order to achieve acceptable mechanical properties while at elevated temperatures resulting from the hot combustion gases. Higher compressor exit temperatures in modern high pressure ratio gas turbine engines can also necessitate the use of high performance nickel superalloys for compressor disks, blisks, and other components. Suitable alloy compositions and microstructures for a given component are dependent on the particular temperatures, stresses, and other conditions to which the component is subjected. For example, airfoil components such as blades and vanes are often formed of equiaxed, directionally solidified (DS), or single crystal (SX) superalloys, whereas turbine disks are typically formed of superalloys that must undergo carefully controlled forging, heat treatments, and surface treatments such as peening to produce a polycrystalline microstructure having a controlled grain structure and desirable mechanical properties.

Turbine disks are often formed of gamma prime (γ') precipitation-strengthened nickel-base superalloys (hereinafter, gamma prime nickel-base superalloys) containing chromium, tungsten, molybdenum, rhenium and/or cobalt as principal elements that combine with nickel to form the gamma (γ) matrix, and contain aluminum, titanium, tantalum, niobium, and/or vanadium as principal elements that combine with nickel to form the desirable gamma prime precipitate strengthening phase, principally $Ni_3(Al,Ti)$. Gamma prime precipitates are typically spheroidal or cuboidal, though a cellular form may also occur. However, as reported in U.S. Pat. No. 7,740,724, cellular gamma prime is typically considered undesirable due to its detrimental effect on creep-rupture life. Particularly notable gamma prime nickel-base superalloys include René 88DT (R88DT; U.S. Pat. No. 4,957,567) and René 104 (R104; U.S. Pat. No. 6,521,175), as well as certain nickel-base superalloys commercially available under the trademarks Inconel®, Nimonic®, and Udimet®. R88DT has a composition of, by weight, about 15.0-17.0% chromium, about 12.0-14.0% cobalt, about 3.5-4.5% molybdenum, about 3.5-4.5% tungsten, about 1.5-2.5% aluminum, about 3.2-4.2% titanium, about 0.5.0-1.0% niobium, about 0.010-0.060% carbon, about 0.010-0.060% zirconium, about 0.010-0.040% boron, about 0.0-0.3% hafnium, about 0.0-0.01 vanadium, and about 0.0-0.01 yttrium, the balance nickel and incidental impurities. R104 has a composition of, by weight, about 16.0-22.4% cobalt, about 6.6-14.3% chromium, about 2.6-4.8% aluminum, about 2.4-4.6% titanium, about 1.4-3.5% tantalum, about 0.9-3.0% niobium, about 1.9-4.0% tungsten, about 1.9-3.9% molybdenum, about 0.0-2.5% rhenium, about 0.02-0.10% carbon, about 0.02-0.10% boron, about 0.03-0.10% zirconium, the balance nickel and incidental impurities.

Disks and other critical gas turbine engine components are often forged from billets produced by powder metallurgy (P/M), conventional cast and wrought processing, and spraycast or nucleated casting forming techniques. Gamma prime nickel-base superalloys formed by powder metallurgy are particularly capable of providing a good balance of creep, tensile, and fatigue crack growth properties to meet the performance requirements of turbine disks and certain other gas turbine engine components. In a typical powder metallurgy process, a powder of the desired superalloy undergoes consolidation, such as by hot isostatic pressing (HIP) and/or extrusion consolidation. The resulting billet is then isothermally forged at temperatures slightly below the gamma prime solvus temperature of the alloy to approach superplastic forming conditions, which allows the filling of the die cavity through the accumulation of high geometric strains without the accumulation of significant metallurgical strains. These processing steps are designed to retain the fine grain size originally within the billet (for example, ASTM 10 to 13 or finer), achieve high plasticity to fill near-net-shape forging dies, avoid fracture during forging, and maintain relatively low forging and die stresses. In order to improve fatigue crack growth resistance and mechanical properties at elevated temperatures, these alloys are then heat treated above their gamma prime solvus temperature (generally referred to as a solution heat treatment or supersolvus heat treatment) to solution precipitates and cause significant, uniform coarsening of the grains.

Though alloys such as R88DT and R104 have provided significant advances in high temperature capabilities of superalloys, further improvements are continuously being sought. For example, high temperature dwell capability has emerged as an important factor for the high temperatures and stresses associated with more advanced military and commercial engine applications. In particular, as higher temperatures and more advanced engines are developed, creep and crack growth characteristics within the rims of turbine disks formed of current alloys tend to fall short of the desired capability to meet mission/life targets and requirements of advanced disk applications. It has become apparent that a particular aspect of meeting this challenge is to develop compositions that exhibit desired and balanced improvements in creep and dwell (hold time) fatigue crack growth rate (DFCGR) characteristics at elevated temperatures seen by disk rims, for example, 1200° F. (about 650° C.) and higher, while also having good producibility and thermal stability.

Creep and crack growth characteristics can be significantly influenced by the presence or absence of certain alloying constituents, as well as by relatively small changes in the levels of the alloying constituents present in a superalloy. However, complicating this challenge is the fact that creep and crack growth characteristics are difficult to improve simultaneously. For example, higher cooling or quench rates from the solution heat treatment can be used to improve creep behavior, but often results in poorer dwell fatigue crack growth rate behavior. While fatigue crack growth resistance can be improved by reducing the cooling rate following the solution heat treatment, such improvements are typically obtained at the expense of creep properties. For these reasons, the cooling rate at the rim of a turbine disk formed of R104 or R88DT is typically limited to maintain an acceptable fatigue crack growth rate within the rim. However, the lower cooling rate within the disk rim reduces rim creep capability. In particular, while a relatively coarse gamma prime precipitate size (promoted by slower cooling) is often optimal in the rim to promote dwell fatigue crack growth resistance, a finer gamma prime precipitate size (promoted by more rapid cooling) is often optimal for disk hubs to promote tensile strength and burst capability, as well as rim creep capability.

An alternative heat treatment approach is to use a slow initial cooling rate (typically less than 10° F. (about 6° C.) per minute) followed by a high temperature hold prior to a rapid quench. With this approach, a serrated or convoluted irregular grain boundary can be formed that is capable of improving dwell time crack growth resistance by creating a more tortuous grain boundary fracture path. However, this approach tends to achieve this benefit at a sacrifice to creep and tensile strengths. Furthermore, such a heat treatment may require an extended hold at the high hold temperature, which is dependent on the specific alloy and below the gamma prime solvus temperature of the alloy, but typically in excess of about 2000° F. (about 1090° C.). Finally, such heat treatments, with their controlled slow cooling rates and extended holds at an intermediate temperature, add complexity to the production and manufacturing of articles.

BRIEF DESCRIPTION OF THE INVENTION

The present invention provides a gamma prime nickel-base superalloy and components formed therefrom that exhibit improved high-temperature dwell capabilities, including creep and dwell fatigue crack growth behavior.

According to a first aspect of the invention, the gamma-prime nickel-base superalloy contains, by weight, 10.00 to 22.0% cobalt, 10.0 to 14.0% chromium, 4.0 to 6.0% tantalum, 2.0 to 4.0% aluminum, 2.0 to 6.0% titanium, 1.5 to 5.0% tungsten, 1.5 to 5.0% molybdenum, 1.0 to 3.5% niobium, 0.05 to 0.6% hafnium, 0.02 to 0.10% carbon, 0.01 to 0.40% boron, 0.02 to 0.10% zirconium, the balance essentially nickel and impurities, wherein the titanium:aluminum weight ratio is 0.7 to 1.5.

According to a second aspect of the invention, the gamma-prime nickel-base superalloy described above is hot worked and heat treated to contain cellular precipitates of gamma prime and finer discrete precipitates of gamma prime. The cellular precipitates comprise arms radiating outward from an origin, with the result that the cellular precipitates have a convoluted border. The finer discrete precipitates tend to be dispersed between the arms of the cellular precipitates and are generally present throughout the grain interior.

According to a third aspect of the invention, a process is provided that entails hot working and heat treating the gamma-prime nickel-base superalloy described above to contain the cellular precipitates of gamma prime described above. The process entails hot working the superalloy to produce an article, heating the article to a supersolvus temperature of the superalloy to solution gamma prime precipitates within the article, and then cooling the article at a rate of about 55° C./minute (about 100° F./minute) or greater from the supersolvus temperature to a temperature of about 1600° F. (about 870° C.) or less.

Another aspect of the invention is components that are formed from the gamma prime nickel-base superalloy described above, particular examples of which include turbine disks and compressor disks and blisks of gas turbine engines.

A significant advantage of the invention is that the cellular gamma prime precipitates cause the superalloy to have serrated or convoluted irregular grain boundaries, creating a tortuous or zig-zag grain boundary fracture path that is believed to be responsible in part for a desirable fatigue crack growth resistance exhibited by the alloy. The irregular grain boundaries are uniquely pronounced and visually appear to create mechanical interlocking of the grains separated by the grain boundaries. Notably, the irregular grain boundaries can be produced without the complexity of the aforementioned prior art heat treatment schedules that have been typically used to produce serrated or convoluted irregular grain boundaries. In particular, the irregular grain boundaries of this invention can be achieved without the use of an initial controlled slow cooling rate and high temperature hold from the solution temperature.

When processed to contain the cellular gamma prime precipitates described above, the superalloy of this invention provides the potential for balanced improvements in high temperature dwell properties, including improvements in both creep and fatigue crack growth resistance at temperatures of 1200° F. (about 650° C.) and higher. The superalloy is also characterized by having good producibility and good thermal stability. Improvements in other properties are also believed possible, particularly if appropriately processed using powder metallurgy and hot working techniques.

Other aspects and advantages of this invention will be better appreciated from the following detailed description.

DETAILED DESCRIPTION OF THE INVENTION

Figure 1:
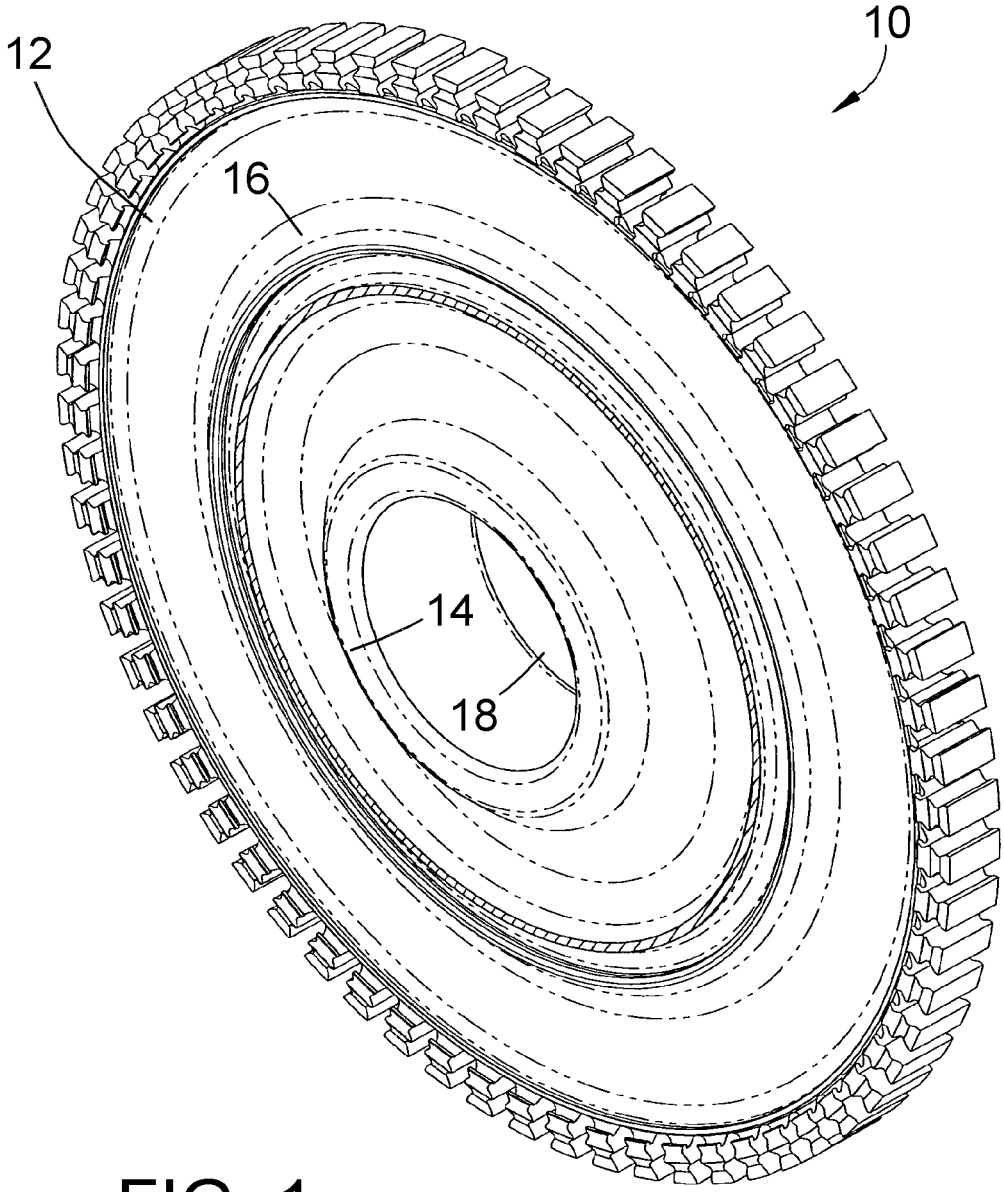
FIG. 1 is a perspective view of a turbine disk of a type used in gas turbine engines.

The present invention is directed to a gamma prime nickel-base superalloy that is particularly suitable for components produced by a hot working (e.g., forging) operation to have a polycrystalline microstructure. A particular example of such a component is represented in FIG. 1 as a high pressure turbine disk 10 for a gas turbine engine. The invention will be discussed in reference to processing of the disk 10, though those skilled in the art will appreciate that the teachings and benefits of this invention are also applicable to compressor disks and blisks of gas turbine engines, as well as other components that are subjected to stresses at high temperatures and therefore require a high temperature dwell capability.

The disk 10 represented in FIG. 1 generally includes an outer rim 12, a central hub or bore 14, and a web 16 between the rim 12 and bore 14. The rim 12 is configured for the attachment of turbine blades (not shown) in accordance with known practice. A bore hole 18 in the form of a through-hole is centrally located in the bore 14 for mounting the disk 10 on a shaft, and therefore the axis of the bore hole 18 coincides with the axis of rotation of the disk 10. The disk 10 is a unitary forging and representative of turbine disks used in aircraft engines, including but not limited to high-bypass gas turbine engines, such as those manufactured by the General Electric Company.

Disks of the type represented in FIG. 1 are typically produced by isothermally forging a fine-grained billet formed by powder metallurgy (PM), a cast and wrought processing, or a spraycast or nucleated casting type technique. In a particular embodiment utilizing a powder metallurgy process, the billet can be formed by consolidating a superalloy powder, such as by hot isostatic pressing (HIP) or extrusion consolidation. The billet is typically forged under superplastic forming conditions at a temperature at or near the recrystallization temperature of the alloy but less than the gamma prime solvus temperature of the alloy. After forging, a supersolvus (solution) heat treatment is performed, during which grain growth occurs. The supersolvus heat treatment is performed at a temperature above the gamma prime solvus temperature (but below the incipient melting temperature) of the superalloy to recrystallize the worked grain structure and dissolve (solution) the gamma prime precipitates (principally $Ni_3(Al,Ti)$) in the superalloy. Following the supersolvus heat treatment, the component is cooled at an appropriate rate to re-precipitate gamma prime within the gamma matrix or at grain boundaries, so as to achieve the particular mechanical properties desired. The component may also undergo aging using known techniques.

Because the bore 14 and web 16 of the turbine disk 10 have lower operating temperatures than the rim 12, different properties are needed in the rim 12 and bore 14, in which case different microstructures may also be optimal for the rim 12 and bore 14. Typically, a relatively fine grain size is optimal for the bore 14 and web 16 to promote tensile strength, burst strength, and resistance to low cycle fatigue (LCF), while a coarser grain size is more optimal in the rim 12 to promote creep, stress-rupture, and dwell LCF, and dwell fatigue crack growth resistance at high temperatures. Also, grain boundary character becomes more important as operating temperatures increase and grain boundary failure modes become the limiting behaviors. This trend toward grain boundary-driven behavior being the limiting factor has led to the use of supersolvus coarse grain processing, in part, to provide a more tortuous grain boundary failure path that promotes improvements in high temperature behavior. Thus grain boundary factors, including the degree to which grain boundaries are serrated to increase the tortuosity of potential grain boundary failure paths, are even more important in a disk rim.

As discussed previously, higher operating temperatures associated with more advanced engines have placed greater demands on turbine disks, and particularly on the creep and dwell crack growth characteristics of turbine disk rims. While dwell fatigue crack growth resistance within the rim 12 can be improved by avoiding excessively high cooling rates or reducing the cooling rate or quench following the solution heat treatment, such improvements are typically obtained at the expense of creep properties within the rim 12. Furthermore, because the disk rim 12 is typically thinner with a reduced cross-section, specific attention must be given to maintain a lower cooling rate, which adds complexity to the disk heat treatment schedule and any cooling rate fixturing or apparatus.

In an effort to address the above issues, superalloy compositions were identified through the use of a proprietary analytical prediction process directed at identifying alloying constituents and levels capable of exhibiting desirable high temperature dwell capabilities relative to existing nickel-base superalloys, including the aforementioned nickel-base superalloys R88DT and R104. Details of this process are reported in co-pending U.S. patent application Ser. No. 12/474,580 (corresponding to U.S. Published Patent Application No. 2010/0303665), and therefore will not be repeated here. As reported in US2010/0303665, the analysis and predictions involved defining elemental transfer functions for tensile, creep, dwell (hold time) crack growth rate, density, and other important or desired mechanical properties for turbine disks. From this analysis, several alloys were identified as exhibiting desirable properties, in particular, a desirable combination of creep and dwell fatigue crack growth rate (DFCGR) characteristics. One of these alloys was referred to in US2010/0303665 as Alloy E, and is the basis for the superalloy of interest to the present invention. In addition to desirable creep and dwell fatigue crack growth rate resistance, Alloy E was characterized by a volume percentage of gamma prime ($(Ni,Co)_3(Al, Ti, Nb, Ta)$) of about 52%, which serves to promote strength at elevated temperatures, for example, 1400° F. (about 760° C.) and higher, over extended periods of time. Alloy E was also determined to have desirable mechanical properties, including an ultimate tensile strength of about 173 ksi (about 1190 MPa), a 0.02% yield strength of about 136 ksi (937 MPa), a 0.2% yield strength of about 152 ksi (about 1050 MPa), elongation of about 20% and a reduction of area of 16% when tested at 1400° F. (about 760° C.), a 0.2% creep (time to 0.2% creep) of 9.5 hours and rupture time of 105.4 hours when tested at 1400° F. and 100 ksi (about 760° C. at about 690 MPa), and a dwell (hold time) fatigue crack growth rate (DFCGR; da/dt) of about $5.43\times10^{-10}$ in/sec (about $1.38\times10^{-8}$ mm/s) when tested at 1400° F. (about 760° C.) using a three hundred second dwell (hold time) and a maximum stress intensity of 20 ksi/in (about 22 MPa/m). It should be noted that the creep, rupture and DFCGR behavior of Alloy E were significantly better than those of R104, which itself is considered to exhibit very good creep and rupture behavior.

Utilizing the results obtained with Alloy E, the present invention identifies a superalloy whose broad, preferred and nominal chemistries are summarized in Table I below.

TABLE I

| Element | Broad | Preferred | Nominal |
|---|---|---|---|
| Co | 10.0-22.0 | 17.0-19.0 | 18 |
| Cr | 10.0-14.0 | 11.0-14.0 | 12.1 |
| Ta | 4.0-6.0 | 4.6-5.6 | 5.1 |
| Al | 2.0-4.0 | 2.6-3.8 | 3.2 |
| Ti | 2.0-6.0 | 2.5-3.7 | 3.1 |
| W | 1.5-5.0 | 2.5-4.5 | 2.8 |
| Mo | 1.5-5.0 | 2.0-5.0 | 2.9 |
| Nb | 1.0-3.5 | 1.3-3.2 | 1.5 |
| Hf | 0.05-0.6 | 0.2-0.6 | 0.4 |
| C | 0.02-0.10 | 0.03-0.08 | 0.055 |
| B | 0.01-0.4 | 0.02-0.04 | 0.025 |
| Zr | 0.02-0.10 | 0.03-0.08 | 0.055 |
| Ni | Balance | Balance | Balance |
| Ti/Al | 0.7-1.5 | 0.98-1.18 | 1.08 |
| Mo/(Mo + W) | 0.3-2.9 | 0.51-0.56 | 0.535 |

The titanium:aluminum weight ratio of the alloy specified in Table I is believed to be important on the basis that higher titanium levels are generally beneficial for most mechanical properties, though higher aluminum levels promote alloy stability necessary for use at high temperatures. The molybdenum:molybdenum+tungsten weight ratio is also believed to be important, as this ratio indicates the refractory content for high temperature response and balances the refractory content of the gamma and the gamma prime phases. In addition, the amounts of titanium, tantalum and chromium (along with the other refractory elements) are balanced to avoid the formation of embrittling phases such as sigma phase or eta phase, which are undesirable and in large amounts will reduce alloy capability. Aside from the elements listed in Table I, it is believed that minor amounts of other alloying constituents could be present without resulting in undesirable properties. Such constituents and their amounts (by weight) include up to 2.5% rhenium, up to 2% vanadium, up to 2% iron, and up to 0.1% magnesium.

Figure 2:
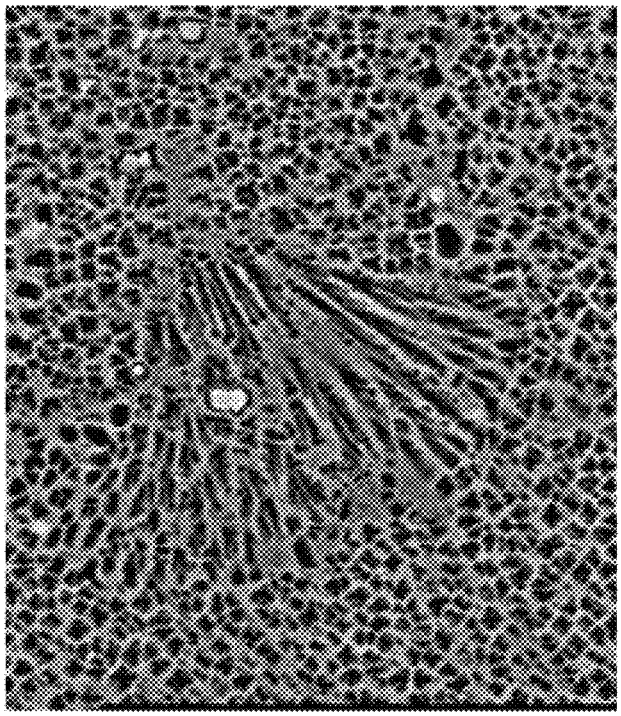
FIG. 2 is a microphotograph showing a cellular precipitate of gamma prime in a nickel-base superalloy processed in accordance with a particular aspect of the present invention.
Figure 3:
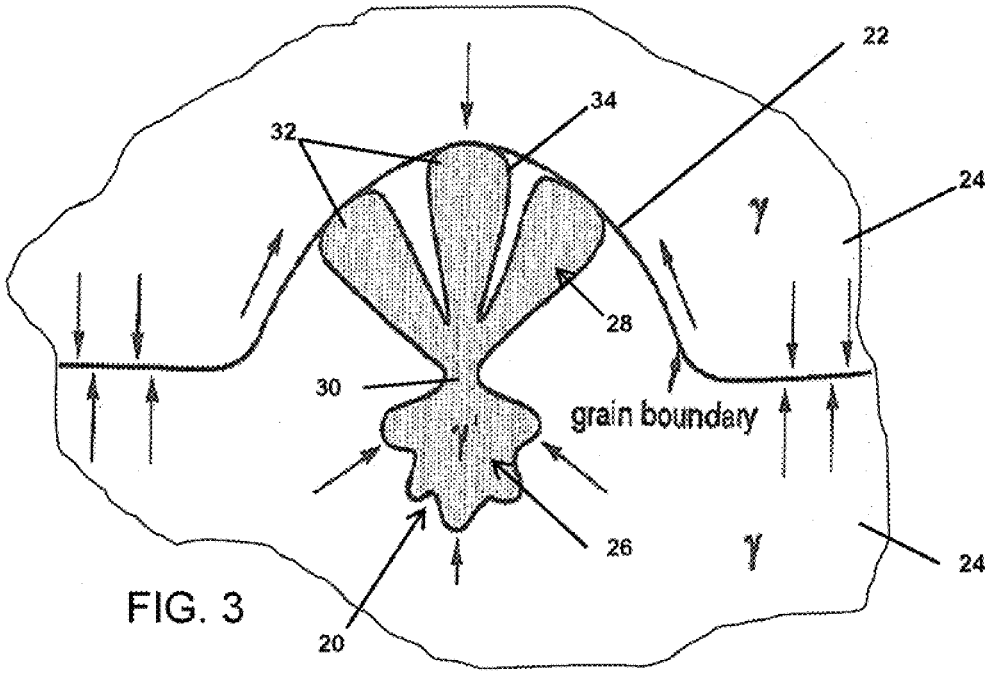
FIG. 3 is a schematic representation of a cellular gamma prime precipitate of the type represented in FIG. 2.

According to a preferred aspect of the invention, the superalloy described in Table I provides the potential for balanced improvements in high temperature dwell properties, including improvements in both creep and fatigue crack growth resistance at elevated temperatures. To achieve these benefits, the superalloy of this invention is processed, including a solution heat treatment and quench, to have a microstructure that contains cellular precipitates of gamma prime. One such precipitate is visible in the microphotograph of FIG. 2, and a cellular precipitate 20 is schematically represented in FIG. 3. In each of FIGS. 2 and 3, the cellular precipitate is represented as having a fan-like structure comprising multiple arms radiating from a common and much smaller origin. The cellular precipitate in FIG. 2 is seen surrounded by considerably smaller (finer) gamma prime precipitates, which are interspersed between the larger arms of the cellular precipitate as well as generally dispersed throughout the grain interior. Compared to the cellular precipitate, the smaller gamma prime precipitates are more discrete and typically cuboidal or spherical, generally of the type, shape and size typically found in gamma-prime precipitation-strengthened nickel-base superalloys. The volume fraction of the smaller gamma prime precipitates is greater than that of the cellular precipitates, and typically in a range of about 43 to about 50 volume percent.

The term "cellular" is used herein in a manner consistent within the art, namely, to refer to a colony of the gamma prime phase that grows out towards a grain boundary in a manner that causes the phase to have the appearance of an organic cell. More particularly, growth of cellular precipitates of gamma prime is the result of a solid-state transformation in which the precipitates nucleate and grow as aligned colonies towards a grain boundary. While not wanting to be held to a particular theory, it is surmised that during the post-solutioning quench, the supersaturated gamma matrix heterogeneously nucleates gamma prime, which grows in the fan structure morphology towards the grain boundary and distorts the grain boundary from its preferred low-energy minimum-curvature path.

The cellular precipitate 20 represented in FIG. 3 is shown as located at a boundary 22 between two grains 24 of the polycrystalline microstructure of the superalloy. The precipitate 20 has a base portion 26 and a fan-shaped portion 28 that extends from a central location or locus point 30 in a direction away from a general origin locus, which may include a base portion 26. Notably, the fan-shaped portion 28 is much larger than the base portion 26 (if present). Furthermore, the fan-shaped portion 28 has multiple lobes or arms 32 that are large and well defined, resulting in the fan-shaped portion 28 having a convoluted border 34. While the arms 32 impart a fan-like appearance to the precipitate 20 when observed in two dimensions, the arms 32 confer a more cauliflower-type morphology when observed in their full three-dimensional nature.

FIG. 3 represents the arms 32 of the fan-shaped portion 28 as extending toward the local grain boundary 22 and distorting its preferred natural path, which is normally a low-energy minimum-curvature path. In the presence of a sufficient volume fraction of cellular precipitates of the type seen in FIG. 2 and represented in FIG. 3, for example, at least 5 volume percent such as about 5 to about 12 volume percent, the grain boundaries of the superalloy tend to have a serrated, convoluted or otherwise irregular shape, which in turn creates a tortuous grain boundary fracture path that is believed to promote the fatigue crack growth resistance of the superalloy. While not wanting to be held to a particular theory, fan-shaped portions of the cellular gamma prime precipitates appear to be preferentially oriented towards the grain boundaries of the superalloy, and the broad fan regions are typically observed to intersect or coincide with the grain boundaries. The apparent growth of the fan-shaped portions is noted to distort the grain boundaries to the extent that the grain boundaries have a very irregular shape, frequently outlining the fan-shaped portions and creating a morphology that exhibits a degree of grain interlocking. Certain grain boundaries have been observed to have a morphology approaching a ball-and-socket arrangement, attesting to the high degree of grain boundary serration or tortuosity caused by the fan-shaped portions.

The superalloy of this invention is capable of forming serrated or tortuous grain boundaries, promoted by the fan-shaped cellular precipitates of the type shown in FIGS. 2 and 3, through the application of a solution heat treatment that solutions all gamma prime precipitates, followed by a cool down or quench at a rate that can be readily attained with conventional heat treatment equipment. Preferred solution heat treatments of this invention also do not require a complex heat treatment schedule, such as slow and controlled initial cooling rates and high temperature holds below the gamma prime solvus temperature, as has been previously required to promote serration formation. Furthermore the serrated and tortuous grain boundaries produced in the superalloy using preferred heat treatments have been observed to have greater amplitude and a higher degree of apparent interlocking than has been produced by simple growth of gamma prime precipitates local to grain boundaries.

A particular example of a heat treatment follows the production of an article from the superalloy using a suitable forging (hot working) process. The superalloy forging is solutioned at a temperature of about 2150° F. (about 1180° C.), after which the entire forging can be cooled at a rate of about 50 to about 300° F./minute (about 30 to about 170° C./minute), more preferably at a rate of about 100 to about 200° F./minute (about 55 to about 110° C./minute). Cooling is performed directly from the supersolvus temperature to a temperature of about 1600° F. (about 870° C.) or less. Consequently, it is unnecessary to perform heat treatments that involve multiple different cool rates, high temperature holds, and/or slower quenches to promote the fatigue crack growth resistance of the superalloy.

In investigations leading up to the present invention, blanks of the superalloy of this invention were prepared to have a nominal composition of, by weight, about 18% cobalt, about 12.1% chromium, about 5.1% tantalum, about 3.2% aluminum, about 3.1% titanium, about 2.8% tungsten, about 2.9% molybdenum, about 1.5% niobium, about 0.4% hafnium, about 0.055% carbon, about 0.025% boron, about 0.055% zirconium, and the balance nickel and incidental impurities. Following forging, all specimens were solution heat treated at a temperature of about 2150° F. (about 1180° C.) for about 60 minutes, after which some specimens were cooled at a rate of either about 100° F./minute or about 200° F./minute (about 55 or about 110° C./minute). The lower rate is typically associated with avoiding undesirably low tensile strength and burst capability of a turbine disk formed of typical nickel-base superalloys such as R104, whereas the higher rate is typically associated with promoting the creep resistance of the rim and properties of the hub of a turbine disk, such as those formed of R104, while avoiding excessive rates that could be detrimental to preferred dwell fatigue crack growth behavior. Still other specimens of the superalloy were cooled using a process that has been shown to promote the fatigue crack growth resistance of turbine disks formed of R104. The cooling process involved slow cooling at a rate of about 4.2° F./minute (about 2.4° C./minute) to a hold temperature of about 2050° F. (about 1120° C.), followed by a hold of about 15 minutes at the hold temperature, and then quenching at a rate of about 200° F./minute (about 110° C./minute) to a temperature of about 1600° F. (about 870° C.).

Figure 4:
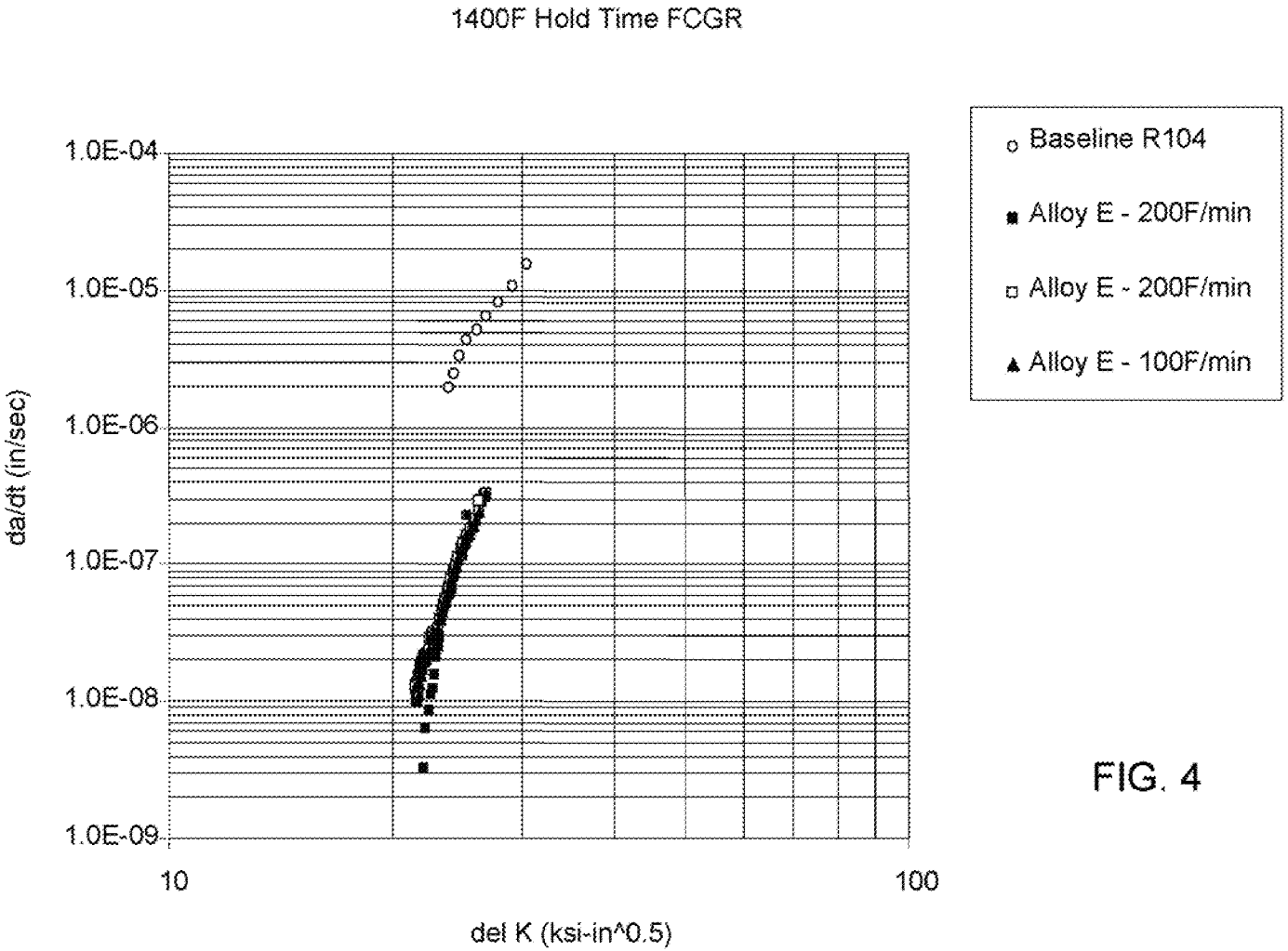
FIG. 4 is a graph plotting dwell (hold time) fatigue crack growth rate versus stress intensity for gamma prime precipitation-strengthened nickel-base superalloys processed in accordance with the present invention.

All specimens were then subjected to dwell (hold time) fatigue crack growth testing at a test temperature of about 1400° F. (about 760° C.) using a three hundred second dwell (hold time) and a maximum stress intensity of 20 ksi √in (about 22 MPa √m). Results of this testing are included in FIG. 4, which includes historical data of R104 for comparison. Surprisingly, regardless of the cooling technique employed, specimens formed from the superalloy of this invention exhibited excellent resistance to dwell fatigue crack growth, with crack growth rates ranging from about $1.0\times10^{-9}$ to about $5.0\times10^{-9}$ in/sec (from about $2.5\times10^{-8}$ to about $1.3\times10^{-7}$ mm/s). This lack of cooling rate dependence is believed to be due in part to the formation of grain boundary serrations from the fan or cellular gamma prime at all cooling rates evaluated.

Evaluations of the microstructures of the specimens formed of the superalloy of this invention indicated that cellular gamma prime precipitates had formed regardless of the cooling technique. FIG. 2 is a microphotograph of one such specimen from this test. Furthermore, it was observed that the cellular precipitates were predominantly located at grain boundaries of the specimens and the grain boundaries were distorted by the cellular precipitates, creating a tortuous grain boundary fracture path that was concluded to be associated with the excellent dwell fatigue crack growth resistance exhibited by the specimens. Four additional alloys produced to have chemistries within the broad range of Table I were also prepared in essentially the same manner as described for the alloys of the investigation discussed above, and each of the additional specimens exhibited varying degrees of the cellular precipitates observed in the alloys of the investigation.

From the above, it was concluded that fatigue crack growth resistance can be improved through the grain boundary shape modification driven by the presence of the fan-shaped cellular gamma prime precipitates, and that such precipitates can be chemistry-driven over a broad range of cooling rates, including cooling rates in excess of 100° C./minute, which are typically associated with improved creep resistance but reduced dwell fatigue crack growth characteristics. The compositional basis for the cellular precipitates is believed to be attributable to the particularly high tantalum and titanium contents of the superalloy. Generally, tantalum is believed to be required at levels of at least 4.0 weight percent and titanium levels are required to be at least 2.0 weight percent and more preferably at least 2.5 weight percent to form the cellular precipitates in sufficient amounts to promote fatigue crack growth characteristics.

While the invention has been described in terms of particular embodiments, including particular compositions, processes and properties for the gamma prime nickel-base superalloy, the scope of the invention is to be limited only by the following claims.

The invention claimed is:

1. A gamma-prime nickel-base alloy having a polycrystalline microstructure, the alloy consisting of, by weight:

10.00 to 22.0% cobalt;
10.0 to 14.0% chromium;
4.0 to 6.0% tantalum;
2.0 to 4.0% aluminum;
2.0 to 6.0% titanium;
1.5 to 5.0% tungsten;
1.5 to 5.0% molybdenum;
1.0 to 3.5% niobium;
0.05 to 0.6% hafnium;
0.02 to 0.10% carbon;
0.01 to 0.40% boron;
0.02 to 0.10% zirconium;
the balance nickel and impurities, wherein the titanium: aluminum weight ratio is 0.7 to 1.5, wherein the polycrystalline microstructure of the alloy contains cellular precipitates of gamma prime and finer precipitates of gamma prime, the cellular precipitates comprising gamma prime arms radiating outward from an origin with the result that the cellular precipitates have convoluted borders, the finer gamma prime precipitates being dispersed between the arms of the cellular precipitates.

2. The gamma-prime nickel-base alloy according to claim 1, wherein the tantalum content of the alloy is, by weight, 4.6 to 5.6%.

3. The gamma-prime nickel-base alloy according to claim 1, wherein the hafnium content of the alloy is, by weight, 0.20 to 0.6%.

4. The gamma-prime nickel-base alloy according to claim 1, wherein the alloy consists of, by weight, 17.0 to 19.0% cobalt, 11.0 to 14.0% chromium, 4.6 to 5.6% tantalum, 2.6 to 3.8% aluminum, 2.5 to 3.7% titanium, 2.5 to 4.5% tungsten, 2.0 to 5.0% molybdenum; 1.3 to 3.2% niobium, 0.20 to 0.60% hafnium, 0.03 to 0.08% carbon, 0.02 to 0.04% boron, 0.03 to 0.08% zirconium, the balance nickel and impurities, wherein the titanium:aluminum weight ratio is 0.98 to 1.18.

5. The gamma-prime nickel-base alloy according to claim 1, wherein the cellular precipitates are predominantly located at grain boundaries of the alloy and the gamma prime arms thereof distort the grain boundaries at which they are located.

6. The gamma-prime nickel-base alloy according to claim 1, wherein the finer gamma prime precipitates are cuboidal or spherical.

7. The gamma-prime nickel-base alloy according to claim 6, wherein the alloy contains about 5 to about 12 volume percent of the cellular precipitates and about 43 to about 50 volume percent of the finer gamma prime precipitates.

8. A rotating component of a gas turbine engine, the rotating component being formed of the gamma-prime nickel-base alloy according to claim 1.

9. The rotating component according to claim 8, wherein the rotating component is a turbine disk or a compressor disk.

10. A gamma-prime nickel-base alloy consisting of, by weight, 10.00 to 22.0% cobalt, 10.0 to 14.0% chromium, 4.0 to 6.0% tantalum, 2.0 to 4.0% aluminum, 2.0 to 6.0% titanium, 1.5 to 5.0% tungsten, 1.5 to 5.0% molybdenum, 1.0 to 3.5% niobium, 0.05 to 0.6% hafnium, 0.02 to 0.10% carbon, 0.01 to 0.40% boron, 0.02 to 0.10% zirconium, the balance essentially nickel and impurities, wherein the titanium:aluminum weight ratio is 0.7 to 1.5, the alloy having a polycrystalline microstructure containing cellular precipitates of gamma prime, the cellular precipitates having fan-shaped portions, at least some of the cellular precipitates being located at grain boundaries of the alloy and the fan-shaped portions thereof distorting the grain boundaries at which they are located resulting in a dwell fracture crack growth rate of about $2.5\times10^{-8}$ to about $1.3\times10^{-7}$ mm/s when subjected to a dwell fatigue crack growth test at a temperature of about 760° C. using a three hundred second dwell and a maximum stress intensity of about 22 MPa√m.

* * * * *

UNITED STATES PATENT AND TRADEMARK OFFICE

CERTIFICATE OF CORRECTION

PATENT NO. : 8,613,810 B2
APPLICATION NO. : 13/099641
DATED : December 24, 2013
INVENTOR(S) : Mourer et al.

It is certified that error appears in the above-identified patent and that said Letters Patent is hereby corrected as shown below:

On the title page, Item [75] Inventors should read: David Paul Mourer, Beverly, MA (US); Kenneth Rees Bain, Loveland, OH (US); Richard DiDomizio, Charlton, NY (US); Timothy Hanlon, Glenmont, NY (US); Daniel Yeuching Wei, Reading, MA (US); Andrew Ezekiel Wessman, Walton, KY (US); Andrew Martin Powell, Cincinnati, OH (US)

Signed and Sealed this
Twenty-seventh Day of January, 2015

Michelle K. Lee

Michelle K. Lee
*Deputy Director of the United States Patent and Trademark Office*